United States Patent [19]

Horikawa

[11] Patent Number: 4,616,539

[45] Date of Patent: Oct. 14, 1986

[54] METHOD OF CUTTING SLIDE FASTENER CHAIN

[75] Inventor: Youichi Horikawa, Toyama, Japan

[73] Assignee: Yoshida Kogyo K. K., Tokyo, Japan

[21] Appl. No.: 756,652

[22] Filed: Jul. 19, 1985

[51] Int. Cl.[4] ..... B26D 5/28

[52] U.S. Cl. ..... 83/42; 83/277; 83/921

[58] Field of Search ..... 83/42, 51, 153, 175, 83/209, 210, 277, 921

[56] References Cited

U.S. PATENT DOCUMENTS 4,043,232 8/1977 Jovin ..... 83/921

4,250,781 2/1981 Nakamura ..... 83/921

*Primary Examiner*—James M. Meister

*Attorney, Agent, or Firm*—Hill, Van Santen, Steadman & Simpson

[57] ABSTRACT

A fastener chain to which a method of the invention is applicable includes space portions where no element is present which are provided at regular intervals along continuous interlocking element trains, and sliders each of which has a pull and is inserted in each length of the element trains lying between two adjacent space portions. The fastener chain is fed in the horizontal direction in the state wherein the bottom stop of each slide fastener section is disposed forwardly of the upper stop of the same fastener section in terms of the feeding direction, and is cut into individual slide fasteners at each of the space portions. The method comprises the steps of feeding the fastener chain to a cutting device in the state wherein the side of the fastener chain on which the pull of the slider inserted in the fastener chain is located faces downwardly and the slider is in contact with or in close proximity to the upper stop, and hanging the pull in such a manner as to be parallel to the working direction of the cutting device when the space portion reaches the cutting device.

2 Claims, 8 Drawing Figures

METHOD OF CUTTING SLIDE FASTENER CHAIN

BACKGROUND OF THE INVENTION

1. Field of the Invention

The present invention relates to a method of cutting a fastener chain into individual slide fasteners at the position of a space portion, the fastener chain including space portions where no element is present which are provided at regular intervals along continuous interlocking element trains, and sliders each of which has a pull and is inserted in each length of the element trains lying between two adjacent space portions.

2. Description of the Prior Art

A method of cutting a fastener chain has heretofore been known in which a fastener chain is moved in a horizontal direction and cut at the position of a space portion, the fastener chain including space portions where no element is present which are provided at regular intervals along continuous interlocking element trains, and sliders each of which is inserted in each length of the element trains lying between two adjacent space portions. Such a method has been previously disclosed in, for example, the specification of U.S. Pat. No. 4,250,781.

The cutting method disclosed in the above-mentioned patent comprises the steps of moving the fastener chain in the horizontal direction in such a manner that its bottom stop is disposed forwardly of an upper stop in terms of the feeding direction, moving the slider in such a manner that it abuts against the upper stop, sensing the position of the slider, thrusting the stopper lever of a space positioning sensor into the space portion to position the fastener chain, and then cutting the chain at the position of the space portion.

According to the conventional cutting method described above, the fastener chain is fed into a cutting device in the state wherein the pull of the slider inserted herein is located on the upper side of the fastener chain and lays on the face of the space portion. Consequently, when the length of the space portion is small or when the pull is long, the pull may interfere with the cutting, disabling it. In such a method, the types of fastener chain which can be cut are disadvantageously limited to those which have a sufficiently long space portion in comparison with the length of the pull.

SUMMARY OF THE INVENTION

Accordingly, a primary object of the present invention is to provide a method of cutting a fastener chain in which, when cutting a fastener chain, cutting action is not adversely influenced by the pull of a slider.

The method according to this invention is applicable to a method of cutting a fastener chain in which the fastener chain includes space portions where no element is present, the space portions being provided at regular intervals along continuous interlocking element trains, and sliders each of which has a pull and is inserted in each length of the element trains lying between two adjacent space portions, the fastener chain being fed in a horizontal direction in such a manner that the bottom stop of each of the slide fastener sections is disposed forwardly of the upper stop of the same fastener section in terms of the feeding direction, and being cut into individual slide fasteners at the position of the space portion. The method of cutting the fastener chain according to the present invention comprises the steps of feeding the fastener chain to a cutting device in the state wherein the side of the fastener chain on which the pull of the slider inserted therein is located faces downwardly and the slider is in contact with or in close proximity to the upper stop, and hanging the pull in such a manner as to be parallel to the working direction of the cutting device when the space portion reaches the cutting device.

In one embodiment of the cutting method according to the present invention, a step of hanging the pull is constituted by a step of enabling it to hang freely from the slider body by virtue of gravity when the space portion reaches the cutting device.

BRIEF DESCRIPTION OF THE DRAWINGS

The above and other objects, features and advantages of the present invention will become more apparent from the following description of the preferred embodiment thereof, taken in conjunction with the accompanying drawings, in which.

DETAILED DESCRIPTION OF THE PREFERRED EMBODIMENT

Figure 1:
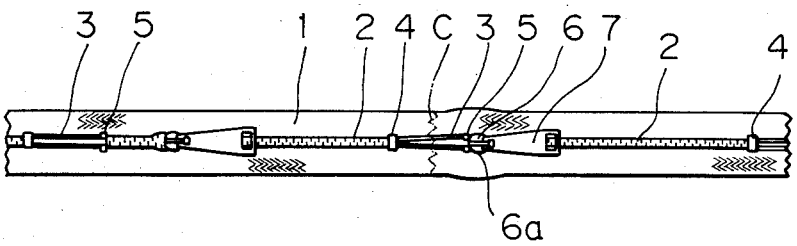
FIG. 1 is a plan view of an example of a fastener chain.

Referring first to FIG. 1, which is a plan view of an example of a fastener chain, a fastener chain 1 includes interlocking element trains 2, and a space portion 3 where no element is present. At the end of the interlocking element trains 2 which is disposed forwardly in terms of the feeding direction, a bottom stop 4 is mounted, while upper stops 5 are mounted on both opposing tapes at the other end disposed rearwardly. A slider 6 has a pull 7 and is inserted in the interlocking element trains 2. The pull 7, as already known, is pivotably mounted on the body of the slider 6*a*.

In addition, a dotted line C denotes a cutting position.

Figure 2:
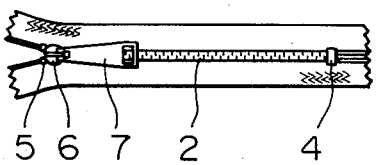
FIGS. 2 and 3 are plan views of slide fasteners which are cut away from the fastener chain.

FIG. 2 is a plan view of a slide fastener which is cut away from the above-mentioned fastener chain 1 at the cutting position C in the space portion 3. In the figure, the slider 6 is pulled up so as to contact the upper stops 5.

Figure 3:
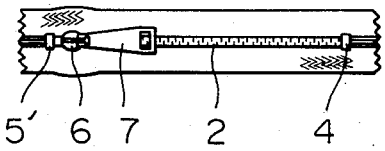

FIG. 3 is a plan view of another slide fastener different from that shown in FIG. 2 which is also cut away. This type employs a bridge type upper stop in which one upper stop 5' is mounted on the two facing tapes. In this case, the slider 6 is pulled up in such a manner that it is close to the upper stop 5'.

Figure 4:
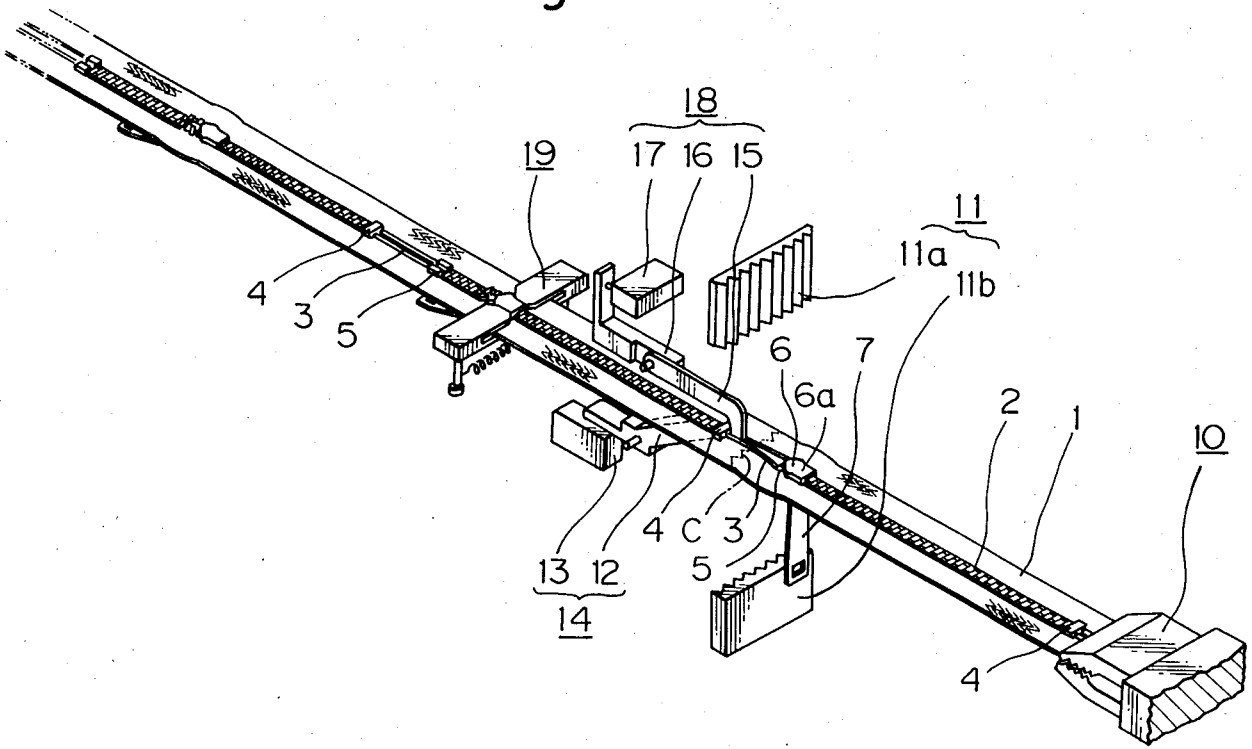
FIG. 4 is a perspective side view of an essential part, illustrating the outline of an apparatus by which the present invention is carried out.

FIG. 4 is a perspective side view of an essential part, illustrating the outline of an example of an apparatus for carrying out the cutting method of the present invention. The apparatus includes a gripper 10 for gripping the end of the fastener chain which is disposed forwardly in terms of the feeding direction in order to feed it, a cutting device 11 consisting of an upper cutter 11*a* adapted to move down for cutting and a lower cutter 11*b* which moves upwardly for cutting, and a slider sensor 14 consisting of a sensing lever 12 provided so as to contact the lower face of the moving fastener chain 1 and which pivots by abutting against the slider 6 and a microswitch 13 which is actuated by the pivoting of the sensing lever 12. The apparatus further includes a space sensor 18 consisting of a stopper lever 15 adapted to pivot in such a manner that the distal end thereof is able to thrust in the tapes in the space portion 3 of the fastener chain 1, a mounting member 16 which pivotably supports the stopper lever 15 around the shaft and is held resiliently so as to slightly and slidably move in the direction in which the fastener chain 1 is moved by any desired means (not shown) and a microswitch 17 which is actuated by the sliding movement of the mounting member 16. Furthermore, the apparatus includes a slider holder 19 which resiliently clamps the slider 6 from its right and left sides during the movement of the fastener chain 1 in such a manner that the slider 6 is releasably fixed at a given portion, and then moves the slider 6 relative to the fastener chain 1 in such a manner that the slider 6 abuts against or comes into close proximity with the upper stops 5.

The apparatus described above generally acts in the same manner as that described in the above-mentioned U.S. Pat. No. 4,250,781.

FIG. 4 shows an apparatus constructed in the above-mentioned arrangement and in a state in which the fastener chain 1 introduced to the apparatus is drawn by a predetermined stroke by the gripper 10 and the upper cutter 11*a* and the lower cutter 11*b* are set for cutting operation.

FIGS. 5A to 5D are explanatory side views of a fastener chain cutting apparatus, successively illustrating the steps of a cutting method of the present invention which is carried out by the apparatus.

Figure 5A:
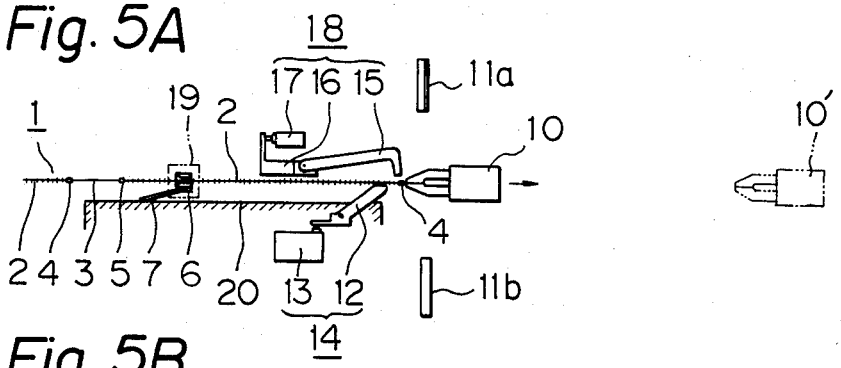
FIGS. 5A to 5D are explanatory side views of the apparatus, successively showing the steps of the cutting method of the embodiment according to this invention.

FIG. 5A shows the apparatus in the state wherein a preceding fastener chain is cut away and the gripper 10 coming from the position shown by 10' to the cut end grips the latter and draws the fastener chain out in the direction shown by an arrow.

At this time, the stopper lever 15 of the space sensor 18 is pulled upward and held in that position by a spring (not shown), making the fastner chain 1 movable. The slider 6 is clamped by the slider holder 19 in such a manner that the slider 6 is temporarily fixed at a given position.

In addition, the reference numeral 20 represents a chain guide.

Figure 5B:
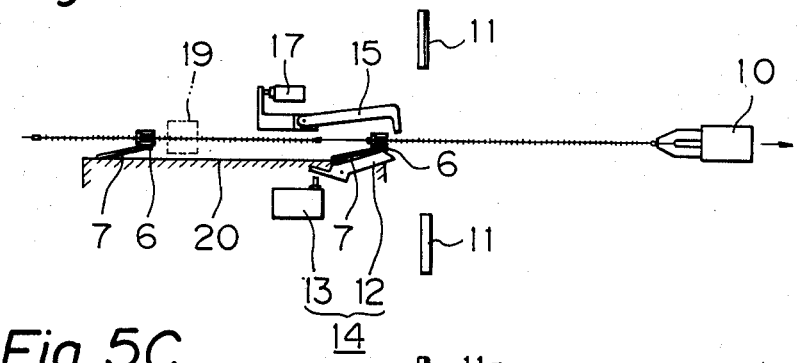

FIG. 5B shows the apparatus in the state wherein the gripper 10 is moved rightwardly and the slider 6 which is relatively displaced to the position of the upper stops 5 drags its pull in a state wherein the pull movably contacts the face of the chain guide 20, abuts against the sensing lever 12 of the slider sensor 14 and pushes the lever down against its resilient force, whereby the microswitch 13 is actuated to transmit the signal for lowering the stopper lever 15 of the space sensor 18.

The signal for lowering the lever passes through a delay circuit matching the chain moving speed and is applied to a known electromagnetic driving mechanism which actuates the stopper lever 15.

Figure 5C:
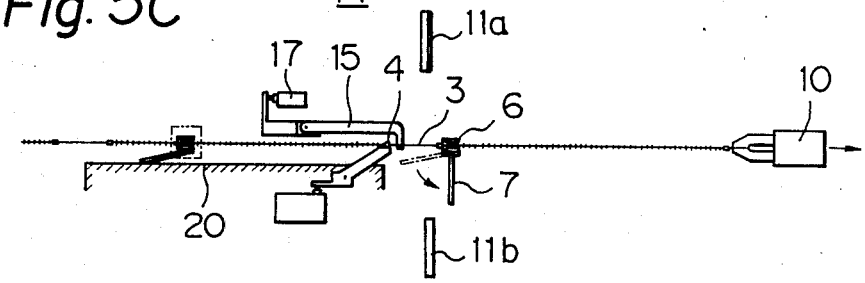

FIG. 5C shows the apparatus in the state wherein the fastener chain 1 is moved further rightwardly and the space portion 3 is positioned beneath the distal end of the stopper lever 15. At this time, by the operation of the electromagnetic driving mechanism actuated by the signal for lowering the stopper lever, the stopper lever 15 is pulled down against the lifting force of the spring and its distal end protrudes into the space portion 3. The length of the chain guide 20 is selectively set such that the pull is released from the support of the guide at this time and becomes vertically suspended from the slider body 6*a* by virtue of gravity.

Figure 5D:
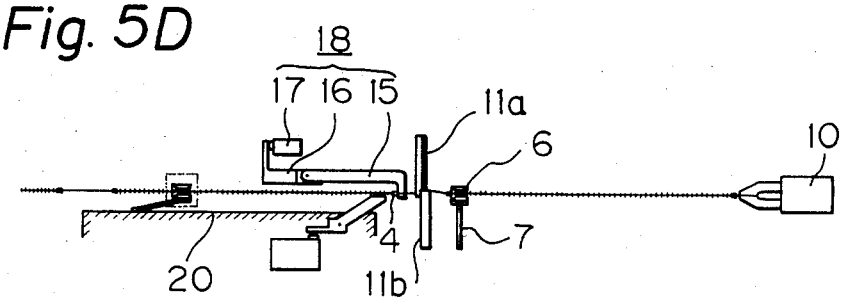

FIG. 5D illustrates the apparatus in the state wherein the gripper 10 is moved still further rightwardly. In this state, when the bottom stop 4 abuts against the distal end of the stopper lever 15 to move the stopper lever 15 rightwardly, its mounting member 16 slidably moves rightwardly to actuate the microswitch 17 and transmit the signal for stopping the movement of the gripper 10 and actuating the cutting device 11, whereby the fastener chain 1 is immediately stopped and at the same time the upper cutter 11*a* and the lower cutter 11*b* are actuated for cutting the fastener chain at the position of the space portion 3.

After conducting the above-described cutting operation, the cut out slide fastener is dropped and discharged by releasing the grip of the gripper 10. At the same time, the stopper lever 15 is pulled up and the upper cutter 11*a* and the lower cutter 11*b* are returned to their original positions, recovering the state shown in FIG. 5A.

Afterwards, the steps described previously are repeated and the moving and cutting of the fastener chain 1 continues without break.

In the above embodiment, the apparatus described includes the slider holder. It is not necessary, however, to employ it when, in a system wherein the cutting of the fastener is done immediately after the process of assembling the slider of the fastener chain, the slider is in contact with or in close proximity to the upper stop at the end of the assembling process.

The present invention is constructed in the above-described arrangement and makes it possible to cut the fastener chain in the state wherein the pull of the slider hangs parallel to the working direction of the cutting device and does not intervene in the movement of the cutter of the cutting device during cutting.

Consequently, it is possible to effect smooth cutting of the fastener chain regardless of the dimension of the pull of the slider even when the length of the space portion is small compared to that of the pull, thereby increasing the productivity of manufacturing slider fasteners.

What is claimed is:

1. In a method of cutting a fastener chain wherein said fastener chain includes space portions where no element is present, said space portions being provided at regular intervals along continuous interlocking element trains, and sliders each of which has a pull and is inserted into each single length of said interlocking element trains lying between two adjacnet space portions, said fastener chain being fed in a horizontal direction in such a manner that the bottom end of each of the slide fastener sections is disposed forwardly of the upper stop of the same fastener section in terms of the feeding direction, and being cut into individual slide fasteners at the position of said space portion, an improvement characterized by comprising the steps of feeding said fastener chain to a cutting device in the state wherein the side of said fastener chain on which said pull of said slider inserted in said fastener chain is located faces downward and said slider is in contact with or in close proximity to said upper stop, and hanging said pull in such a manner as to be parallel to the cutting direction of said cutting device when said space portion reaches said cutting device.

2. A method of cutting a fastener chain defined in claim 1, wherein the step of hanging said pull is constituted by a step of enabling said pull to hang freely from the body of said slider by virtue of gravity when said space portion reaches said cutting device.

* * * * *